US011043316B2

(12) United States Patent
Weber et al.

(10) Patent No.: US 11,043,316 B2
(45) Date of Patent: Jun. 22, 2021

(54) METHOD OF MAKING A MINERAL-INSULATED, COMPACTED, BENDABLE CABLE

(71) Applicant: ARI Industries, Inc., Addison, IL (US)

(72) Inventors: Robert Weber, Addison, IL (US); Kenneth Browall, Addison, IL (US)

(73) Assignee: ARI Industries, Inc., Addison, IL (US)

( * ) Notice: Subject to any disclaimer, the term of this patent is extended or adjusted under 35 U.S.C. 154(b) by 105 days.

(21) Appl. No.: 16/190,290

(22) Filed: Nov. 14, 2018

(65) Prior Publication Data

US 2019/0148035 A1 May 16, 2019

Related U.S. Application Data

(60) Provisional application No. 62/585,861, filed on Nov. 14, 2017.

(51) Int. Cl.
*H01B 13/00* (2006.01)
*H01B 13/004* (2006.01)
*H01B 13/22* (2006.01)

(52) U.S. Cl.
CPC ..... *H01B 13/004* (2013.01); *H01B 13/221* (2013.01); *H01B 13/224* (2013.01)

(58) Field of Classification Search
CPC ..... H01B 7/1895; H01B 7/0009; H01B 7/04; H01B 7/20; H01B 7/16; H01B 13/004; H01B 13/221; H01B 13/224; H01B 3/56
USPC ..... 29/861
See application file for complete search history.

(56) References Cited

U.S. PATENT DOCUMENTS 4,998,341 A * 3/1991 Jones ..... G01K 7/02 29/828
5,346,116 A * 9/1994 Hall, Jr. ..... B21C 37/08 228/148

FOREIGN PATENT DOCUMENTS

WO WO-2018005653 A1 * 1/2018 ..... G01R 33/02

* cited by examiner

*Primary Examiner* — Peter Dungba Vo
*Assistant Examiner* — Azm A Parvez
(74) *Attorney, Agent, or Firm* — Kinney & Lange, P.A.

(57) ABSTRACT

A mineral-insulated cable has a non-circular cross-sectional shape that does not allow the internal wires to twist or change alignment during manufacturing of the cable.

4 Claims, 4 Drawing Sheets

METHOD OF MAKING A MINERAL-INSULATED, COMPACTED, BENDABLE CABLE

CROSS-REFERENCE TO RELATED APPLICATION(S)

This application claims the benefit of U.S. Provisional Application No. 62/585,861 filed Nov. 14, 2017 for "MINERAL-INSULATED, METAL-SHEATHED, COMPACTED, BENDABLE CABLE WHOSE SHAPE DOES NOT ALLOW THE INTERNAL WIRES TO TWIST OR CHANGE ALIGNMENT DURING PRODUCTION" by Robert Weber and Kenneth Browall. The aforementioned U.S. Provisional Application No. 62/585,861 filed Nov. 14, 2017 is hereby incorporated by reference in its entirety.

BACKGROUND

Mineral-insulated cable (or MI cable) is a variety of electrical cable that features an electrical conductor (or conductors) inside a metallic sheath, insulated by compacted ceramic insulation. MI cables are used as thermocouple cables, electric heater cables, and as conductor cables for carrying signals from sensors and carrying power and critical signals to equipment and facilities.

The manufacturing of MI cable typically begins with three components—a metal tube or pipe (which will become the outer metallic sheath), crushable ceramic insulators (which become the compacted insulation and the heat conductor out to the outer metallic sheath), and electrical conductors or wires (which extend the length of the MI cable and are surrounded by the compacted insulation). These three components are assembled with the ceramic insulators and the wires inside the metal tube, and are then subjected to a process that includes swaging one end so that the swaged end can fit through a drawing die. The components are subjected to multiple drawing and annealing (heat treating) steps. With each draw process, the diameter of the drawing passage of the drawing die being used is smaller. As a result, the cross-sectional dimensions of the metal tube get smaller and the length of the metal tube gets longer with each draw. The looseness of the internal structure (the insulation and the wires) decreases as the cross section of the metal tube gets smaller with each draw process. After each draw process, the metal tube turns hard and brittle, and the annealing is used to condition the metal tube to make it soft enough to perform the next drawing process. The series of draw and annealing processes continues until the MI cable has reached its final dimensions.

The initial or starting metal tube or pipe typically has a circular cross section and has a larger inner diameter, a larger outer diameter and a larger wall thickness than the resulting metallic sheath of the manufactured MI cable. Various metals and metal alloys can be used for the metal tube, including different grades of stainless steel (such as 304, 310, 316, etc.), high oxidation resistant alloys such as Inconel 600, copper alloys, nickel alloys, and refractory metals such as tantalum and platinum.

The crushable ceramic insulators can be pre-formed with holes so that the wires can be fed through the holes. Magnesium oxide (magnesia) is a typical ceramic material used to provide the insulation in MI cables.

The electrical conductors (wires) can be as few as one wire to eight or more wires in a single MI cable. The wires are spaced within the MI cable so that they do not contact one another and do not contact the inner wall of the metallic sheath. The composition of the wires will depend on the intended use of the MI cable. For example, different Ohms/foot linear resistance will be required for the wires of an electric heater cable than for a cable being used for signal transmission. Thermocouple cable may require wires that are different than those used for either heater cable or signal transmission cable.

During the manufacturing process, the wires within the MI cable become twisted or change alignment as a result of the repeated series of drawing and annealing steps. The wires inside standard circular MI cable twist as they are drawn down through standard circular draw dies. Draw dies for standard circular MI cable have circular bearing regions. Draw die manufacturers normally produce circular bearing regions for their dies.

Tubing and insulator for standard circular MI cable do not need be a special shape. Circular tubing and insulators are the normal shape for those respective materials from manufacturers.

SUMMARY

A mineral-insulated, metal-sheathed, compacted, bendable cable has a non-circular cross-sectional shape that does not allow the internal wires to twist or change alignment during manufacturing of the cable.

DETAILED DESCRIPTION

Figure 1:
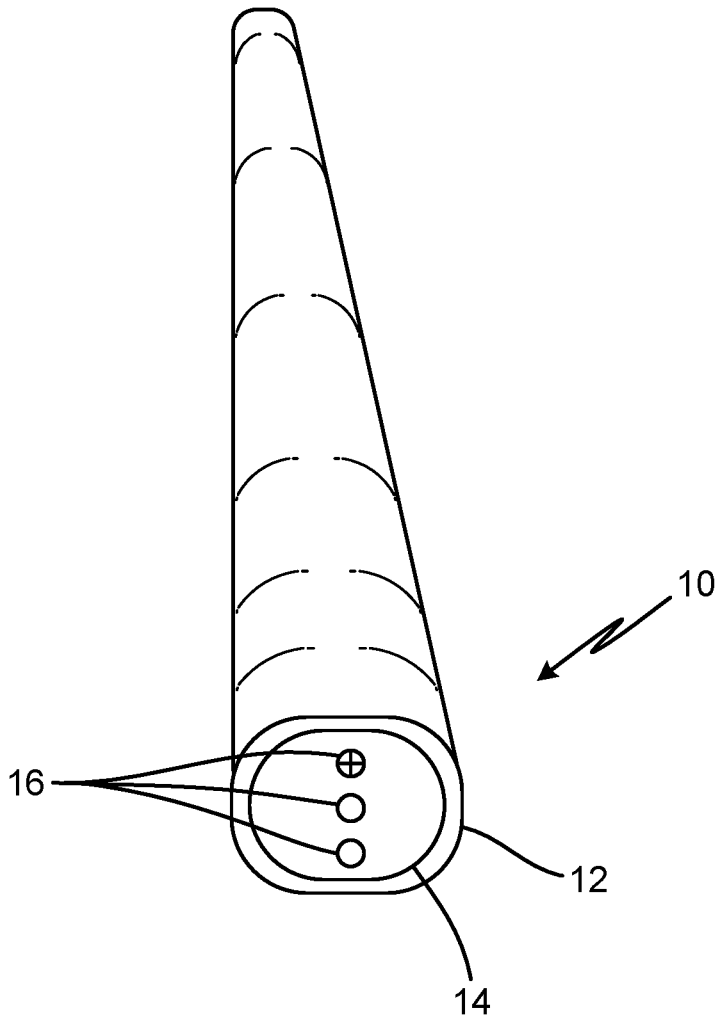
FIG. 1 is a photograph of a bendable compacted MI cable having an ovular shaped cross section that prevents the internal wires from twisting or changing alignment during manufacturing of the MI cable.

FIG. 1 is a photograph showing MI cable 10, which includes sheath 12, insulation 14, and three wires 16. MI cable 10, in this embodiment, has an ovular cross-sectional shape with a major axis and a minor axis, which does not allow turning while being drawn. The objective of the design is to create a mineral-insulated, metal-sheathed, compacted, bendable cable whose shape does not allow the internal wires to twist or change alignment during production.

Figure 2C:
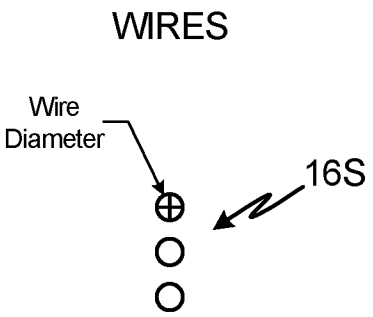
FIGS. 2A-2C show end views of the tubing, insulator, and wire components, respectively, used in the manufacture the MI cable of FIG. 1.
Figure 2B:
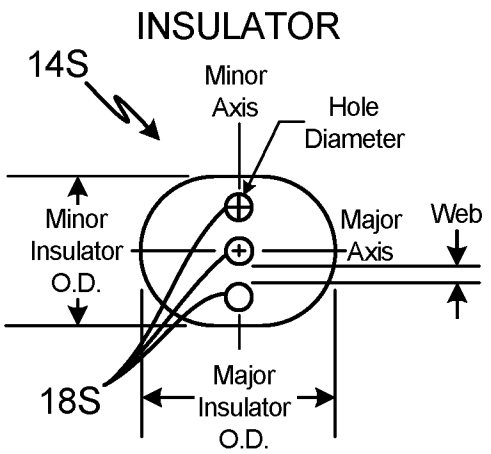
Figure 2A:
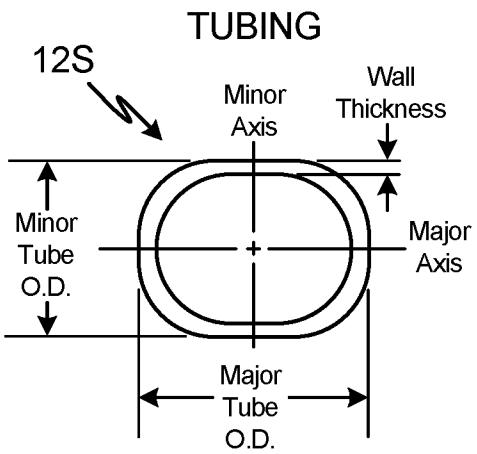

FIGS. 2A-2C show the starting components used to produce MI cable 10, with their starting dimensions. FIG. 2A shows an end view of starting tube 12*s*. FIG. 2B shows an end view of starting insulator 14*s*, which includes wire holes 18*s*. FIG. 2C is an end view of starting wires 16*s*.

Starting tube 12*s* must have a shape that does not allow turning while being drawn (any shape that is not perfectly circular). The tube material can be any material that will withstand the working conditions of the final product and be able to be drawn down through draw die reductions and anneals (i.e. various metals and metal alloys, including different grades of stainless steel (such as 304, 310, 316, etc.), high oxidation resistant alloys such as Inconel 600, copper alloys, nickel alloys, and refractory metals such as tantalum and platinum).

Starting insulator 14*s* must have a shape that does not allow turning while being drawn (any shape that is not perfectly circular). The insulator should be made of a ceramic material (e.g. magnesium oxide) that is crushable and will electrically separate the wires from each other and the sheath in the final product at normal operating conditions. In the embodiment shown, the cross-sectional shape of starting insulator 14*s* matches the cross-sectional shape of starting tubing 12*s*, but is smaller to allow insertion of starting insulator 14*s* into starting tubing 12*s*.

Any normal wire material and shape will work for starting wires 16*s*. The outer diameter of starting wires 16*s* is smaller than the diameter of the wire holes 18*s* in starting insulator 14*s*. The wire material used for starting wires 16*s* can be any material that will withstand the working conditions of the final product and be able to be drawn down through draw die reductions and anneals (i.e. various metals and metal alloys, including different grades of stainless steel (such as 304, 310, 316, etc.), high oxidation resistant alloys such as Inconel 600, copper alloys, nickel alloys, and refractory metals such as tantalum and platinum).

Figure 3:
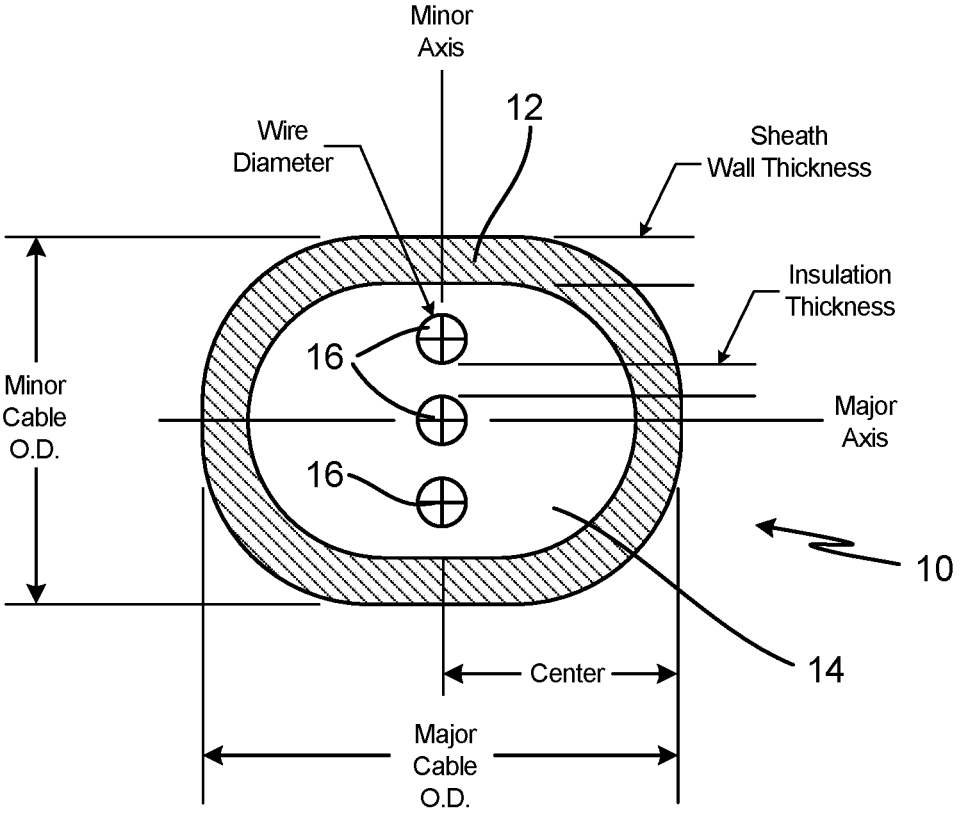
FIG. 3 shows a cross-sectional view of the MI cable of FIG. 1.

FIG. 3 is a cross-sectional view of finished MI cable 10 after the drawing and annealing processes have been completed. The cable shown is in its compacted form where the major and minor O.D.'s have been reduced in size. The final cable has compacted the powder around the wires and provides the electrical insulation with the I.D. of the sheath in full contact with the compacted insulation.

The draw dies used in manufacturing of MI cable 10 must have an equivalent shape to that of the tubing and ceramic insulation. The size of the die openings (bearing diameter) is progressively smaller to reduce the material.

Figure 4A:
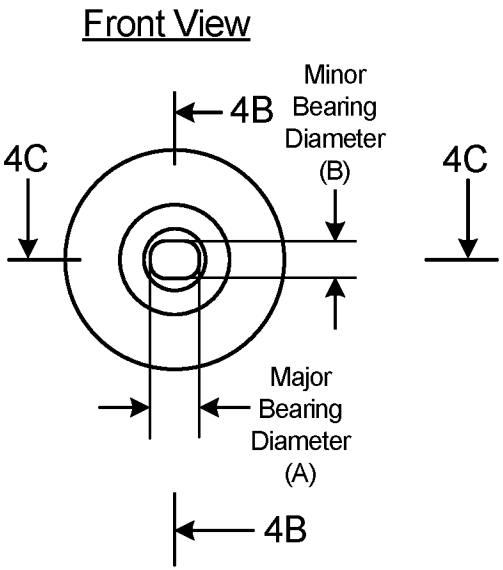
FIG. 4A is a front view of a draw die used in manufacturing of the MI cable of FIG. 1.
Figure 4C:
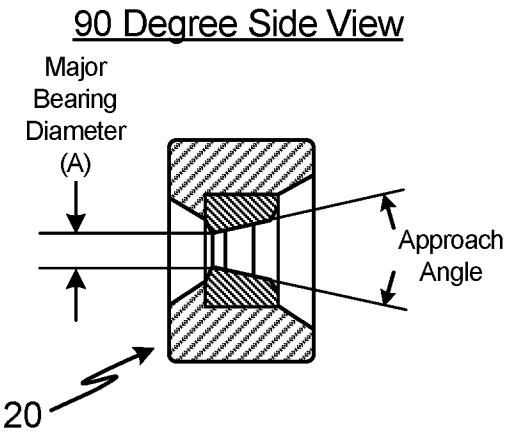
FIG. 4C is a sectional view of the draw die of FIG. 4A along section 4C-4C.
Figure 4B:
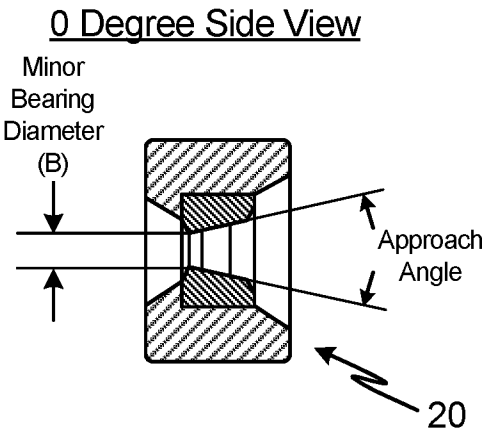
FIG. 4B is a sectional view of the draw die of FIG. 4A along section 4B-4B.

FIG. 4A is an end (or front) view of die 20, which is one of the draw dies used in the drawing process. FIGS. 4B and 4C are sectional views that show the minor bearing diameter and the major bearing diameter, respectively, of die 20.

All tubing and wires are cleaned using standard procedures. The tubing has one end pointed for feeding the tubing through the draw die and into a pulling mechanism. The ceramic insulators are cleaned by firing at an elevated temperature using standard procedures. The wires have the special shaped ceramic insulators strung over them. The special shaped tubing is filled with the string of wires and ceramic insulators. The back end of the filled tubing is crimped to ensure the ceramic insulators do not fall out during the first draw procedure. The material is drawn and annealed to the desired size using a series of special shaped dies with successively smaller die openings that match the shape of the starting materials. Care must be taken during each drawing procedure. Operators must line up the material with the draw die opening profile to prevent twisting, tearing, and scratching of the cable. Because the special shaped ceramic insulators have a non-circular outer surface that matches the non-circular inner surface of the tubing, twisting and changes in alignment of the insulators and the wires within the insulators with respect to the tubing is inhibited.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of making a mineral-insulated, compacted, bendable cable having a shape that does not allow internal wires to twist or change alignment during production, the method comprising:

inserting, into a metal tube having a non-circular cross-sectional shape with a major axis and a minor axis, a plurality of starting insulators of a crushable ceramic material having a non-circular cross-sectional shape that is similar to the non-circular cross-sectional shape of the metal tube and having a plurality of aligned spaced holes each containing an electrically conductive wire, the starting insulators shaped to have a non-circular outer surface that matches an inner surface of the metal tube to inhibit twisting and changes of alignment of the starting insulators and the wires;

swaging a first end of the metal starting tube to form a pointed leading end for feeding the metal tube through a draw die and into a pulling mechanism;

crimping a second end of the metal starting tube to contain the insulators within the metal tube;

performing a series of drawing and annealing processes in which, during each successive drawing and annealing process, the metal tube, the insulators, and the wires are drawn through a draw die having a successively smaller draw opening shaped to match the non-circular cross-section of the metal tube and with a smaller major axis and a smaller minor axis, to reduce cross-sectional dimensions of the metal tube and to crush the crushable ceramic insulators to form a compacted ceramic powder that fills the metal tube and surrounds the wires, while maintaining the cross-sectional shape of the metal tube and without causing the wires to twist or change alignment.

2. The method of claim 1, wherein the plurality of aligned spaced holes are aligned in a plane and are parallel to one another.

3. The method of claim 2, wherein the plane is aligned with the minor axis of the starting insulators.

4. The method of claim 3, wherein the plurality of aligned spaced holes include three parallel holes.

* * * * *